US006293429B2

(12) United States Patent
Sadler et al.

(10) Patent No.: US 6,293,429 B2
(45) **Date of Patent: *Sep. 25, 2001**

(54) VARIABLE-RATE, DIGITALLY-CONTROLLED FLUID METERING DEVICE

(75) Inventors: Edward John Sadler; Carl R. Camp; Dean E. Evans, all of Florence, SC (US); Lonnie J. Usrey, Gainesville, GA (US)

(73) Assignee: The United States of America as represented by the Secretary of the Department of Agriculture, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/131,363

(22) Filed: Aug. 7, 1998

(51) Int. Cl.[7] ..... B67D 5/18

(52) U.S. Cl. ..... 222/61; 222/62; 222/64; 222/69; 222/288; 222/399; 222/444

(58) Field of Search ..... 222/52, 61, 62, 222/64, 67, 69, 288, 394, 399, 442, 444

(56) References Cited

U.S. PATENT DOCUMENTS

| | | | | |
|---|---|---|---|---|
| 3,194,434 | * | 7/1965 | Evanson | 222/444 |
| 3,306,504 | * | 2/1967 | Tischler | 222/442 |
| 4,583,664 | * | 4/1986 | Bayat | 222/69 |
| 4,734,109 | | 3/1988 | Cox . | |
| 4,818,706 | * | 4/1989 | Starr | 222/442 |
| 4,867,192 | | 9/1989 | Terrell et al. . | |
| 5,012,955 | * | 5/1991 | Shannon | 222/61 |
| 5,134,961 | | 8/1992 | Giles et al. . | |
| 5,156,179 | | 10/1992 | Peterson et al. . | |
| 5,246,164 | | 9/1993 | McCann et al. . | |
| 5,271,526 | | 12/1993 | Williams . | |
| 5,294,023 | * | 3/1994 | Ioannides et al. | 222/61 |
| 5,417,346 | * | 5/1995 | Ferri, Jr. et al. | 222/399 |

OTHER PUBLICATIONS

C. Camp and E. Sadler, 1994 International Winter ASAE Meeting, Dec. 13–16, 1994.

* cited by examiner

*Primary Examiner*—Kenneth Bomberg
(74) *Attorney, Agent, or Firm*—M. Howard Silverstein; John D. Fado; Gail E. Poulos

(57) ABSTRACT

A variable-rate, digitally controlled fluid metering device having an electronically controlled 3-way valve, a fluid reservoir, a float valve, a check valve and a pressure relief valve that accurately delivers low flow volumes. The flow rate of the device is the product of reservoir volume and pulse rate when the cycle is long enough to fill and empty the reservoir and is a linear combination of cycle time when the cycle is short enough that the reservoir does not fill or empty completely. This device allows the use of large orifice emitters for delivering low flow rates of fluids, which allows the use of lower quality fluids and/or reduces filtration steps and clogging of emitters.

8 Claims, 6 Drawing Sheets

VARIABLE-RATE, DIGITALLY-CONTROLLED FLUID METERING DEVICE

BACKGROUND OF THE INVENTION

1. Field of the Invention

This invention relates to a variable-rate, digitally-controlled fluid metering device for use in applications such as, for example, mixing of fluids, injecting variable volumes of fluid into fluid streams, spraying chemicals in process lines, cooling of rooftops, livestock, poultry etc. The invention also relates to the use of the fluid metering device in spray irrigation systems.

2. Description of the Related Art

Conventional methods vary emitter size or pressure to regulate flow rates of fluids, which can cause problems because of limited range of pressures and flows, changed pattern radius, and changed distribution uniformity within the pattern. For sprinkler systems, problems occur because of changed pattern radius and changed distribution uniformity within the pattern. For injection of fluid treatment agents, nozzles usually have relatively small passages for low volume flow rates, which are highly prone to plugging if small sized particulate matter is present in the injection fluids. Furthermore, in systems such as, for example, agricultural irrigation systems, it is desirable to discharge precise amounts of fluids regardless of pressure variations. Standard sprinklers in agricultural irrigation systems, use fixed-orifice designs, which have corresponding pressure-flow relationships. By design, the flow rate of a given sprinkler at a given pressure is fixed. In movable irrigation systems, application depths are altered in practice by altering the travel rate of the sprinkler over the ground. Constant-speed machines use time-proportional control, meaning they must stop periodically to reduce average travel velocity. Intermittent motion degrades the uniformity of application, and the uniformity is worse for smaller sprinkler pattern radii. Alignment control of multi-span center pivot and linear-move machines superimposes another start/stop pattern on inner towers. Some standard sprinklers are used in a time-proportional, switched mode. Solenoid valves turn the supply on and off in a controllable sequence. The control variable is the length of time the water is on relative to the cycle time. The dynamics of the solenoid are a limiting factor and the uniformity of application may not be adequate.

U.S. Pat. No. 5,134,961 (Giles et al) discloses a device for controlling volumetric flow through pressure atomization sprays. Each nozzle is connected to a direct acting, in-line solenoid valve which is connected to a liquid supply at constant pressure. The valve is excited by square wave pulses of variable frequency and duty cycle to reciprocate between its fully open and closed positions and thereby control the flow rate over a range without changing the droplet size and spray pattern.

U.S. Pat. No. 4,867,192 (Terrell et al) discloses an apparatus for controlling irrigation water pH by blending a minute stream of sulfuric acid into a flowing water stream. The sulfuric acid pumps are variable displacement, positive displacement pumps which are electrically driven and controlled by a controller through electrical circuits.

U.S. Pat. No. 5,271,526 (Williams) discloses a programmable additive controller which controls the flow of fluid additives. A flowmeter is connected to a solenoid control valve for measuring flow of fluid. The controller opens and closes the valve and incorporates an input for required quantities of additive to be added each cycle. This system has a minimum injection per cycle of about 5 or fewer cc's per cycle. A comparator in the controller compares a required quantity with signal output indicating flow through the flowmeter. The difference between actual flow and target flow is continuously sent so that the target flow is continuously adjusted up or down when necessary to compensate for the previous difference.

While various devices have been developed for variable flow of fluids, there still remains a need in the art for a more effective and accurate device for delivering fluids at variable flow rates. The present invention provides a variable-flow rate, digitally-controlled fluid metering device that can use any type of emitter for delivering fluids at a wide range of flow rates by controlling the pulse rate for a given reservoir volume. The controllable range of flow rates can be expanded by replacing with different sized reservoirs. The present invention is different from prior art devices and solves some of the problems associated with the prior art devices. The present invention allows the use of large orifice emitters for delivering low volumes of fluids which allows the use of low quality fluids and/or reduces filtration steps and clogging of emitters.

SUMMARY OF THE INVENTION

It is therefore an object of the present invention to provide a digitally-controlled device that allows variable flow rates of fluids with positive displacement.

A further object of the present invention is to provide a fluid metering device with a flow rate that is a linear combination of cycle time when cycle time is short enough that the reservoir of the device does not fill or empty completely.

Another object of the present invention is to provide a device where the instantaneous flow rate from zero to maximum is controlled by a limited duration pulse.

Another object of the present invention is to provide a fluid metering device where flow rate is proportional to the number of pulses.

Further objects and advantages of the invention will become apparent from the following description.

DETAILED DESCRIPTION OF THE INVENTION

The present invention is a variable-rate, positive displacement, digitally-controlled fluid metering device that works by cycling between a charging state, during which a fixed volume fills with fluid, and a discharging state, during which the volume is forced through an emitter attached to device 10, at the outlet end of valve 24, by a pulsed higher-pressure inert fluid, such as a gas, like air for example. As used herein, the term emitter means anything that delivers a fluid, either gas or liquid, such as for example, sprinkler heads, injection nozzles, industrial spray nozzles, open orifices, etc. The volume of fluid storage is a design parameter that can be easily altered to provide small changes in aggregate flow rate, providing for a wider range of possible flow rates, and providing a range of flow rates for a constant pulse rate using different sized reservoirs. The primary variable is pulse rate, which can vary the instantaneous flow rate from zero to maximum. This is accomplished with a square waveform of given duration with adjustable frequency.

Figure 1:
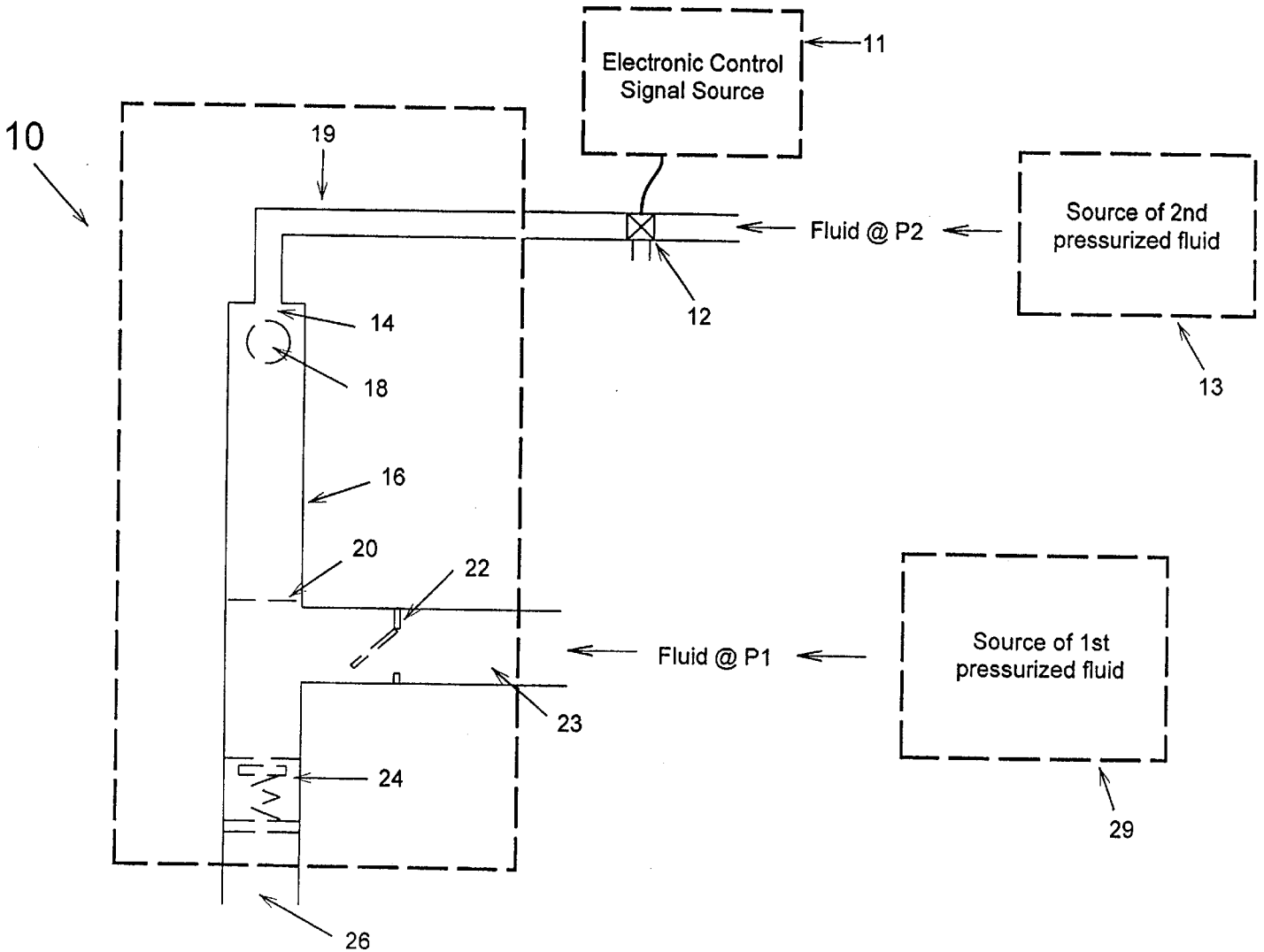
FIG. 1 is a schematic drawing of fluid metering device 10 showing electronic control signal source 11, an electronically controlled 3-way valve 12, source of a second pressurized fluid 13, float check valve 14, fluid reservoir 16, floating ball 18, means for retaining ball 20, check valve 22, fluid supply line 23, pressure relief valve 24, source of a first pressurized fluid 29 and outlet 26.

FIG. 1 shows a schematic of fluid metering device 10 according to the present invention, comprising an electronically controlled 3-way valve 12, a float check valve 14, floating ball 18, a fluid reservoir 16, a means 20 for restricting the travel of ball 18 within said reservoir 16, a check valve 22, a fluid supply line 23 and pressure relief valve 24.

The inlet end of electronically controlled 3-way valve 12, a solenoid valve for example, operatively connects to the outlet end of source 13 of a second pressurized fluid, such as a gas; nitrogen, air, etc., for example, or a liquid. By definition, source 13 includes for example, compressors, pumps, bottled gases, bottled liquids, etc. The outlet end of controlled 3-way valve 12 operatively connects to the inlet end of float valve 14 through pipe 19 (See FIG. 1). Valve 14 is operatively connected to the inlet end of reservoir 16. Valve 14 is required to vent the second pressurized fluid during the charging cycle. The vented fluid can be optionally captured and recycled. Valve 12 is controlled by electronic control signal source 11, which can be any means to create a discrete on-off signal, by way of example, a programmable logic controller (PLC), a PC with an analog/digital I/O board, a data logger, etc. Reservoir 16, containing floating ball 18, is operatively connected to the outlet end of valve 14 and the inlet end of pressure relief valve 24. Reservoir 16 is any means suitable for containing a fluid, under pressure, to be emitted. It is cylindrical in shape and can be removable in order to have different sizes of reservoirs which have different volumes per pulse. It can be cast from any rigid inert material, such as for example metals including brass, bronze or stainless steel, etc.; plastics such as PVC, and composites. Material choice is dependent on the application of device 10. The design and fabrication is well within the ordinary skill in the art. Floating ball 18 travels vertically within reservoir 16. Ball 18 is made up of any chemically inert low density material that is capable of sealing valve 14, floating in the first pressurized fluid which is being emitted by device 10 and sinking in the second pressurized fluid. Chemically inert low density material is defined as any material that does not chemically react with the fluids used in device 10, such as for example, PVC.

Figure 3:
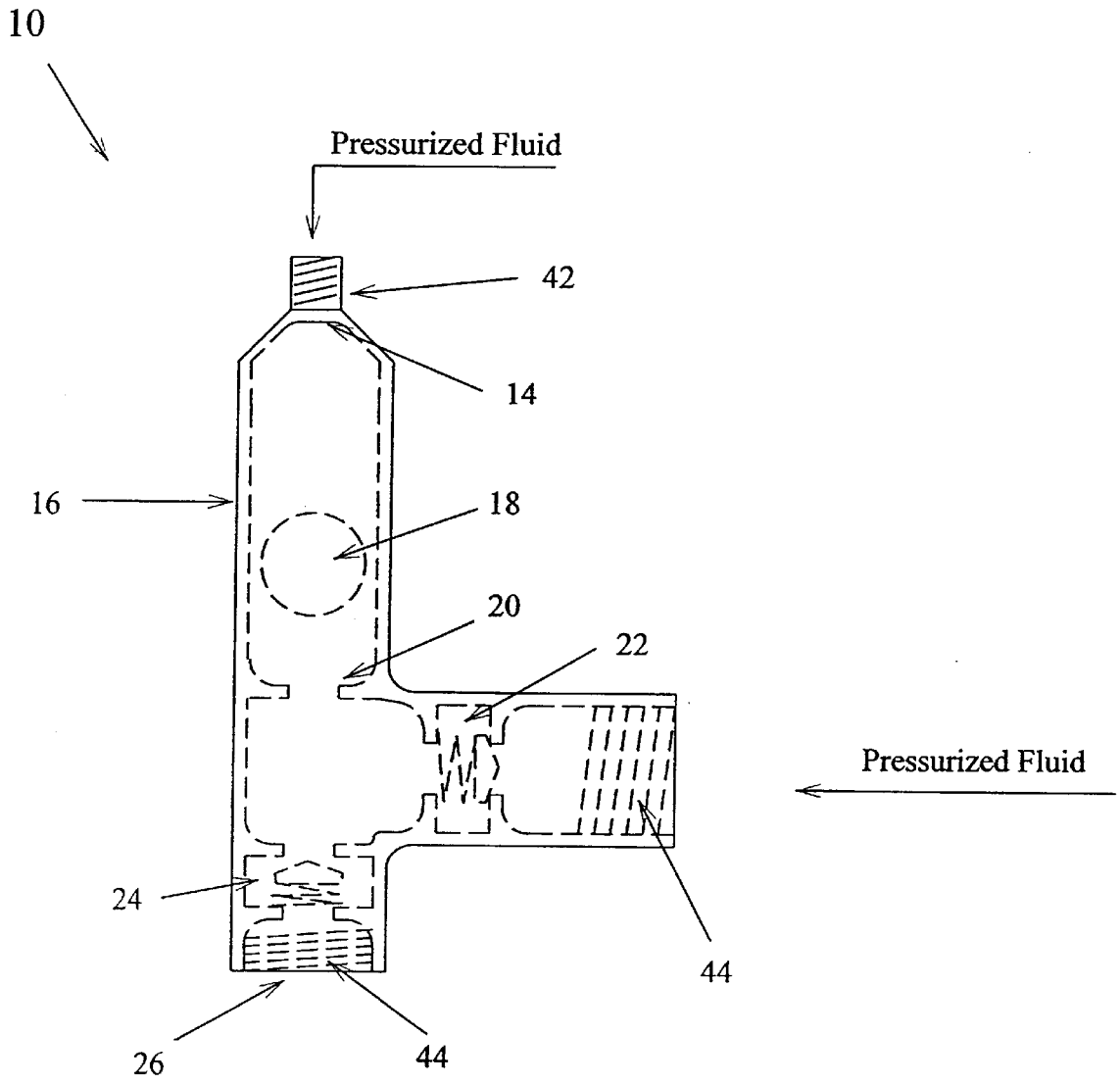
FIG. 3 shows a cut-away view of another embodiment of device 10 showing male N.P.T. connection 42, female N.P.T. connections 44, float check valve 14 with floating ball 18 and float ball restraint 20; reservoir 16, check valve 22, pressure relief valve 24 and outlet 26.

Means 20 for retaining ball 18 is located below reservoir 16 just above the entry of the first pressurized fluid from fluid supply line 23. Means 20 is anything that stops ball 18 but does not restrict fluid flow into or out of reservoir 16. Means 20 can be, for example, a retaining screw, a pin, screening material, etc. Means 20 also may be molded into the body of reservoir 16 as depicted in FIG. 3. Means 20 and valve 14 restrict the movement of ball 18 within reservoir 16.

Reservoir 16 is operatively connected to source 29 of a first pressurized fluid at pressure P1 through check valve 22 that is connected to fluid supply line 23 between reservoir 16 and source 29. The first pressurized fluid is the controlled fluid, and has a density greater than that of ball 18. Check valve 22 prevents back flow of reservoir fluids into fluid supply line 23. Pressure relief valve 24 is operatively connected to reservoir 16 below the outlet end of reservoir 16, usually through tee 36 between reservoir 16 and valve 24 (See FIG. 2). Valve 24 operatively connects reservoir 16 with a fluid emitter through outlet 26 of device 10.

Figure 2:
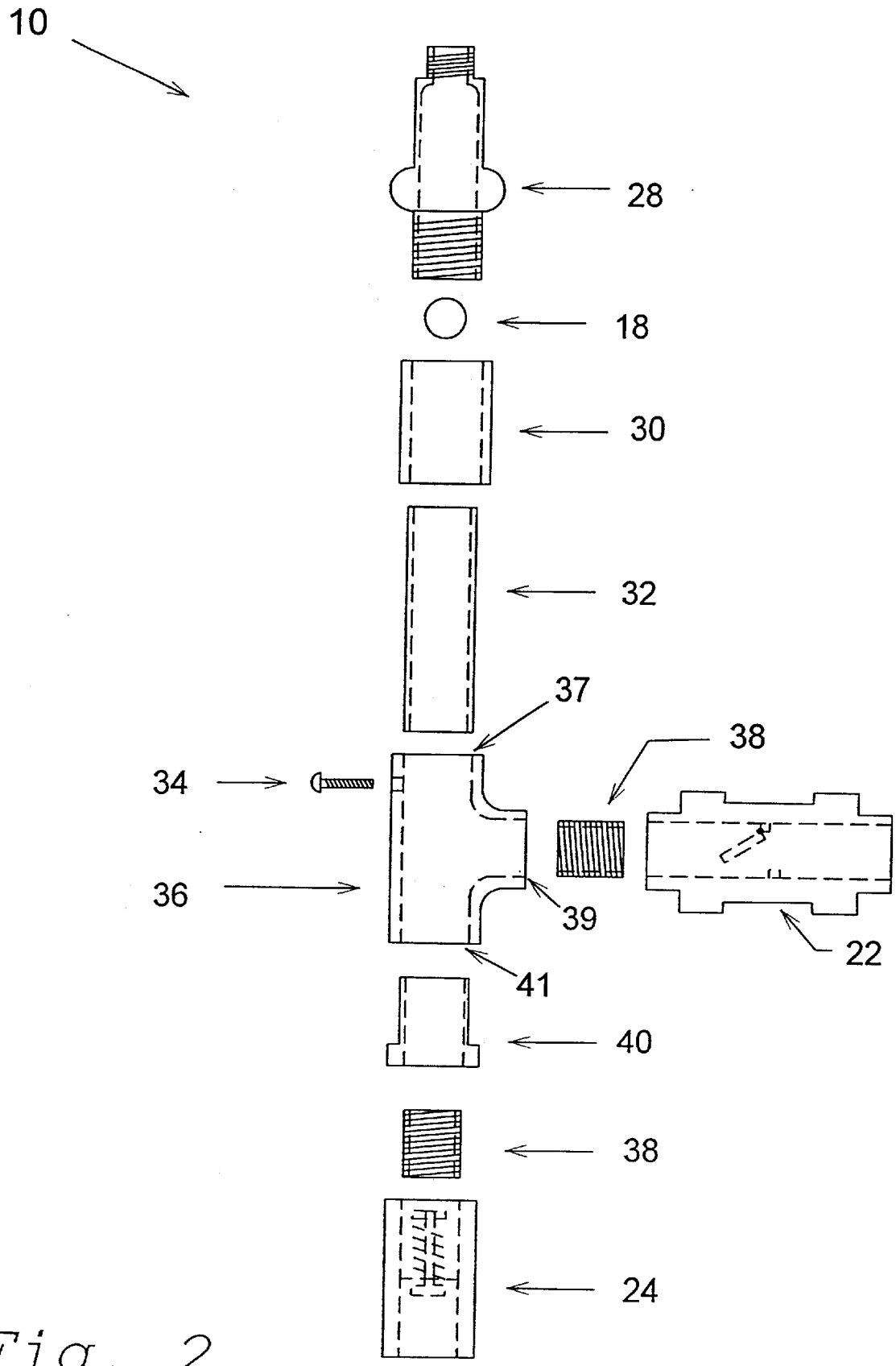
FIG. 2 is an exploded view of one embodiment of device 10 showing vacuum breaker casing 28, floating ball 18, retaining screw 34, pipe 32, female adapter 30, tee 36, first inlet 37, first threaded nipple 38, second inlet 39, outlet 41, check valve 22, reducing bushing 40, second threaded nipple 38 and pressure relief valve 24.

In one embodiment of the invention, depicted in FIG. 2, vacuum breaker casing (including valve seat) 28 functions as float valve 14 described above for the schematic of device 10. Vacuum breaker casing 28 is removable and replaceable. Vacuum breaker casing 28 operatively connects to a source of a second pressurized fluid at pressure P2 through pipe 19 (not shown, see FIG. 1) and an electronically controlled 3-way valve 12 (not shown, see FIG. 1). Female adaptor 30 and pipe 32 make up reservoir 16 (Depicted in FIG. 1). To change the volume of reservoir 16, pipe 32 is removable and changeable so that different lengths of pipe can be used to vary volume. Ball 18 is movably located in vacuum breaker casing 28, female adaptor pipe 30 and pipe 32. Tee 36 operatively connects the outlet end of pipe 32 to valves 22 and 24 by threaded or solvent-welded connection, for example. A first inlet 37 of tee 36 contains retaining screw 34 which extends through enough of the diameter to prevent passage of ball 18. A first threaded nipple 38 operatively connects check valve 22 to a second inlet 39 of tee 36. Check valve 22 operatively connects a first pressurized fluid source at P1 (not shown) to device 10 and also is a fluid supply line 23 as depicted in FIG. 1. Valve 22 prevents backflow into the fluid supply line. Outlet 41 of tee 36 operatively connects to pressure relief valve 24 through reducing bushing 40 and a second threaded nipple 38. The outlet end of valve 24 is operatively connected to an emitter means for distributing fluids as described above.

In another embodiment, device 10 is molded as separate parts which are welded together to make one unit as shown in FIG. 3. The location of welds, depending on fabrication considerations and the use of standard components, is well within the ordinary skill in the art. For example, in FIG. 3, the float ball restraint 20 and the seat to check valve 22 and valve 24 may be molded into the body or constructed separately and pressed or glued into place. Molded device 10 has a standard externally threaded N.P.T. connection 42 at the inlet end of valve 14 and internally threaded N.P.T. connections 44 at the inlet end of valve 22 and the outlet end of valve 24. This embodiment is operatively connected to the sources of pressurized fluids and emitter as described above. In this embodiment, casting necessarily fixes the reservoir volume, meaning that different sizes would be cast separately.

In operation, during the charging state, signal source 11 (FIG. 1) activates 3-way valve 12, which shuts off the second pressurized fluid source 13 and allows the first pressurized fluid at pressure P1 to enter reservoir 16 and pressurized fluid of P2 is displaced from reservoir 16 to the atmosphere or a recovery vessel (not shown). As reservoir 16 fills, the floating ball 18 seals with valve 14 closing off the inlet end of valve 14. As pressure in reservoir 16 builds up to pressure P1, check valve 22 closes. Reservoir 16 is now charged and ready to be discharged. This is initiated by an electrical pulse from source 11, which switches the electronically controlled 3-way valve 12. When valve 12 opens, it releases a second pressurized fluid at pressure P2, where P2>P1, which causes discharge of the reservoir fluid by forcing open pressure relief valve 24 and closing check valve 22 if it is not already closed. The duraton of the pulse is usually determined as the minimum duration required to empty the reservoir. The maximum is whatever is necessary for the application of device 10. For some applications, it may be desirable for the cycle time to be shorter than that needed to completely fill and empty reservoir 16. If such a short cycle time is used, the metering device produces a volume per pulse less than the volume of reservoir 16, depending upon the ratio of the charge time to that for a full charge, and upon the ratio of the discharge time to that for a full discharge.

The following examples illustrate the invention and are not intended to limit the scope of the invention as defined by the claims. Tests were conducted with air for the propelling or control fluid at P2 and water as the dispensed or controlled fluid at P1.

EXAMPLE 1

Figure 4:
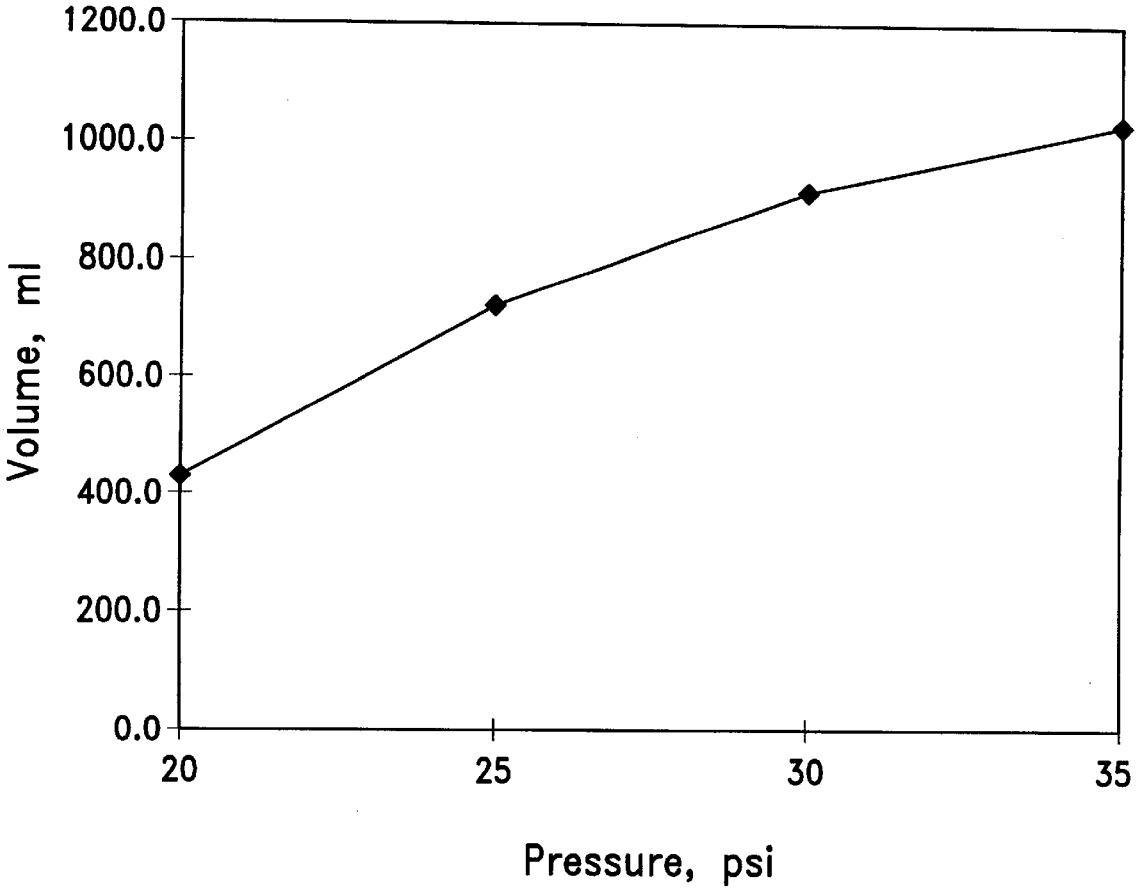
FIG. 4 is a graph showing volume of fluid discharged by device 10, shown in FIG. 2, with variable pressure.
Figure 5:
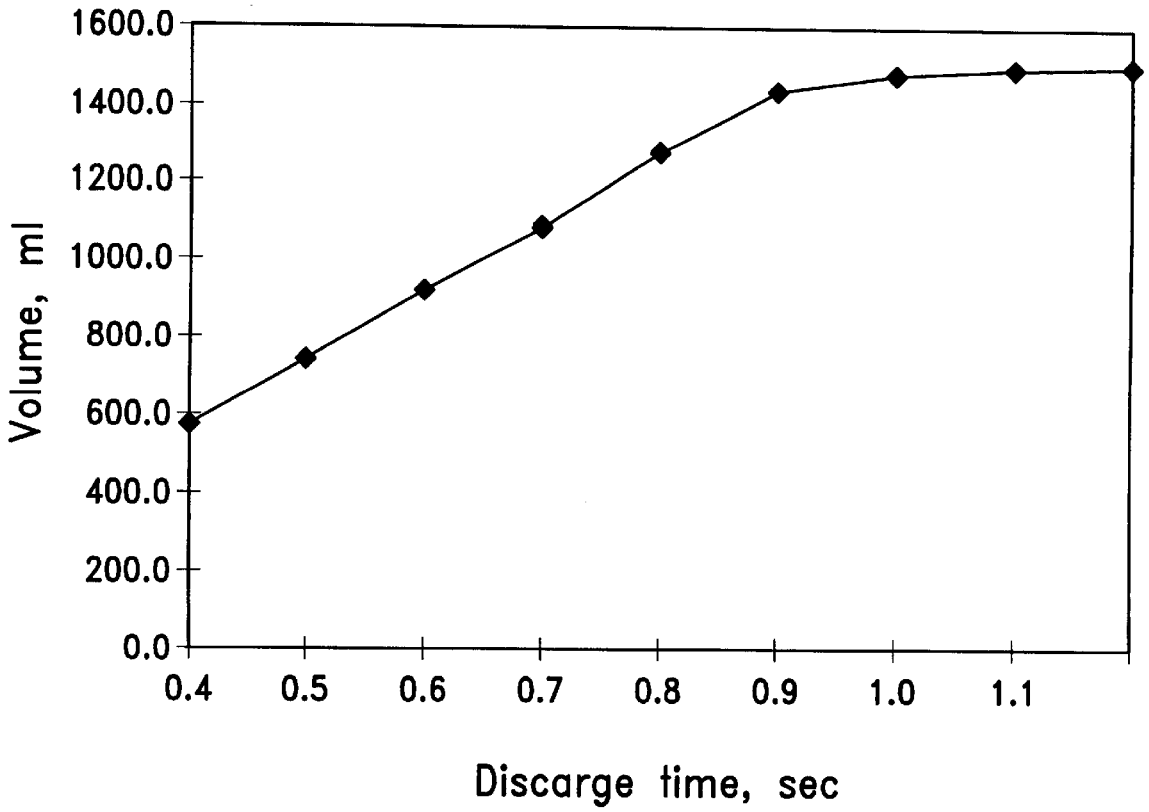
FIG. 5 is a graph showing volume of fluid discharged by device 10, shown in FIG. 2, with variable discharge time.
Figure 6:
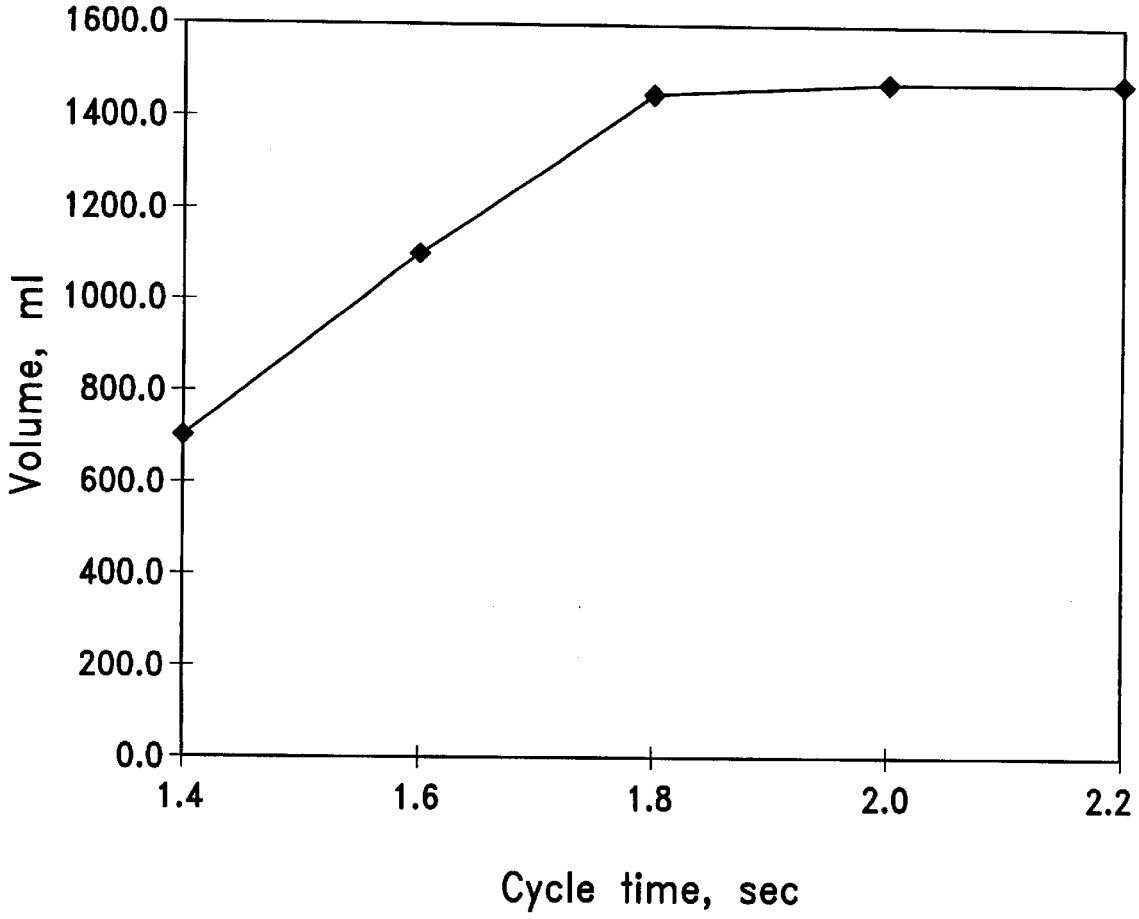
FIG. 6 is a graph showing volume of fluid discharged by device 10, shown in FIG. 2, with variable cycle time.

Tests were conducted to illustrate flow rates and volumes when pressure, discharge time and cycle times are varied. In the first test, air pressure was varied from about 20 psi to about 35 psi, water pressure was about 10 psi, cycle time was about 1.5 seconds and discharge time was about 0.6 seconds. The results are shown in Table 1 below and FIG. 4. In the second test, discharge time was varied from about 0.4 second to about 1.2 seconds, water pressure was about 10 psi, air pressure was about 30 psi and cycle time was about 3 seconds which allowed reservoir 16 to fully recharge. The results are shown in Table 2 below and FIG. 5. In the third test, cycle time was varied from about 1.4 seconds to about 2.2 seconds, charge time was varied from about 0.4 second to about 1.2 seconds. In this instance, cycle time equaled charge time plus 1.0 second. Water pressure was about 10 psi, air pressure was about 30 psi and discharge time was about 1 second. The results are shown in Table 3 below and FIG. 6. In the fourth test, cycle time was varied from about 1.20 seconds to about 2.00 seconds and discharge time was varied from about 0.6 second to about 1.00 second and individual pulse volumes were measured. See Table 4 below for the results.

The results of the above tests show that repeatable flow rates and volumes are obtained with several combinations of time when the cycle was short enough that the reservoir did not fill or empty completely. This extends the range of control parameters under which the device performs predictably. Operation above the threshold produces a fixed volume per pulse, yielding a flow rate proportional to the pulse frequency. Operation below the threshold produces flow volumes proportional to the charge and discharge duration as a fraction of the duration allowing full charge/discharge.

TABLE 1

VARIABLE AIR PRESSURE

Water press. = 10 psi
Cycle time = 1.5 sec
Discharge time = 0.6 sec

| | Volume/10 cycles, ml | | | | |
|---|---|---|---|---|---|
| Pressure | Rep 1 | Rep 2 | Rep 3 | Avg. | Std. Dev |
| 20 | 420 | 425 | 435 | 426.7 | 7.6 |
| 25 | 725 | 715 | 720 | 720.0 | 5.0 |
| 30 | 915 | 915 | 920 | 916.7 | 2.9 |
| 35 | 1030 | 1025 | 1030 | 1028.3 | 2.9 |

TABLE 2

VARIABLE DISCHARGE TIME

Water press. = 10 psi
Air press. = 30 psi
Cycle time = 3 sec (this allows time for chamber to fully recharge)

| Discharge time | Volume/10 cycles, ml | | | | |
|---|---|---|---|---|---|
| sec. | Rep 1 | Rep 2 | Rep 3 | Avg. | Std. Dev. |
| 0.4 | 560 | 570 | 570 | 566.7 | 5.8 |
| 0.5 | 735 | 735 | 745 | 738.3 | 5.8 |
| 0.6 | 920 | 920 | 910 | 916.7 | 5.8 |
| 0.7 | 1090 | 1090 | 1090 | 1090.0 | 0.0 |
| 0.8 | 1280 | 1285 | 1285 | 1283.3 | 2.9 |
| 0.9 | 1440 | 1440 | 1435 | 1438.3 | 2.9 |
| 1.0 | 1475 | 1475 | 1475 | 1475.0 | 0.0 |
| 1.1 | 1490 | 1490 | 1495 | 1491.7 | 2.9 |
| 1.2 | 1495 | 1500 | 1500 | 1498.3 | 2.9 |

TABLE 3

VARIABLE CYCLE TIMES

Water press. = 10 psi
Air press. = 30 psi
Discharge time = 1 sec

| Cycle time | Charge | Volume/10 cycles, ml | | | | |
|---|---|---|---|---|---|---|
| sec. | time | Rep 1 | Rep 2 | Rep 3 | Avg. | Std. Dev. |
| 1.4 | 0.4 | 695 | 710 | 710 | 705.0 | 8.7 |
| 1.6 | 0.6 | 1100 | 1100 | 1110 | 1103.3 | 5.8 |
| 1.8 | 0.8 | 1450 | 1445 | 1445 | 1446.7 | 2.9 |
| 2.0 | 1.0 | 1460 | 1460 | 1465 | 1461.7 | 2.9 |
| 2.2 | 1.2 | 1460 | 1465 | 1465 | 1463.3 | 2.9 |

TABLE 4

INDIVIDUAL PULSE VOLUMES

Water press. = 10 psi
Air press. = 30 psi

| Cycle | Discharge | Volume, ml | | | | | | |
|---|---|---|---|---|---|---|---|---|
| time | time | Rep 1 | Rep 2 | Rep 3 | Rep 4 | Rep 5 | Avg. | St. Dev. |
| 2.00 | 1.00 | 154 | 149 | 149 | 149 | 148 | 149.8 | 2.4 |
| 1.75 | 0.80 | 130 | 128 | 128 | 128 | 127 | 128.2 | 1.1 |
| 1.20 | 0.60 | 91 | 93 | 92 | 90 | 90 | 91.2 | 1.3 |

The foregoing detailed description is for the purpose of illustration. Such detail is solely for that purpose and those skilled in the art can make variations therein without departing from the spirit and scope of the invention.

INDEX OF THE ELEMENTS

10. Fluid Metering Device
11. Electronic Control Signal Source
12. Electronically Controlled 3-Way Valve
13. Source of Second Pressurized Fluid
14. Float Check Valve
16. Fluid Reservoir
18. Floating Ball
20. Means for Retaining Ball
22. Check Valve
23. Fluid Supply Line
24. Pressure Relief Valve
26. Outlet
28. Vacuum Breaker Casing
29. Source of First Pressurized Fluid
30. Female Adaptor (Slip X Thread; FIG. 2)
32. Pipe
34. Retaining Screw
36. Tee (Slip X Slip X Thread; FIG. 2)
37. First Inlet of Tee
38. Threaded Nipple
39. Second Inlet of Tee
40. Reducing Bushing (Slip X Thread; FIG. 2)
41. Outlet of Tee
42. External N.P.T. Connection
44. Internal N.P.T. Connection

We claim:

1. A fluid metering device consisting essentially of:

a fluid reservoir for containing a first fluid under pressure P1 with a floating ball within said reservoir, a means for restricting travel of said ball within said reservoir, an electronic pulsed signal generator operatively connected to an electronically controlled three-way valve, said electronically controlled three-way valve operatively connected to said reservoir and to a source of a second fluid under pressure P2 wherein said valve is controlled by said signal generator to provide variable flow rates of said first fluid in a series of pulses of known volume, a float check valve operatively connecting said three-way valve with said reservoir, a check valve operatively connecting said reservoir with a source of said first fluid under pressure P1, a pressure relief valve operatively connected to said reservoir and to an outlet end of said device, and a means for emitting operatively connected to the outlet end of said device.

2. A digitally-controlled fluid metering device consisting essentially of:

a fluid reservoir for containing a first fluid under pressure P1 with a floating ball within said reservoir, a means for restricting travel of said ball within said reservoir, an electronic pulsed signal generator selected from the group consisting of a programmable logic controller, a PC with an analog/digital I/O board, a datalogger and a circuit, wherein said generator is connected to an electronically controlled three-way valve, said electronically-controlled three-way valve operatively connected to said reservoir and to a source of a second fluid under pressure P2 wherein said valve is controlled by said signal generator to provide variable flow rates of said first fluid in a series of pulses of known volume, a float check valve operatively connecting said three-way valve with said reservoir, a check valve operatively connecting said reservoir with a source of said first fluid under pressure P1, a pressure relief valve operatively connected to said reservoir and to an outlet end of said device, and a means for emitting operatively connected to the outlet end of said device.

3. The device of claim 1 or 2 wherein said reservoir is a removable reservoir in order to insert different sizes of reservoirs which have different volumes per pulse.

4. A digitally-controlled fluid metering device consisting essentially of:

a fluid reservoir for containing a first fluid under pressure P1, an electronic pulsed signal generator operatively connected to an electronically controlled three-way valve, said electronically controlled three-way valve operatively connected to said reservoir and to a source of a second fluid under pressure P2 wherein said valve is controlled by said signal generator to provide variable flow rates of said first fluid in a series of pulses of known volume, a float check valve operatively connecting said three-way valve with said reservoir, and a check valve operatively connected to said reservoir and to a source of a first fluid under pressure P1.

5. A digitally-controlled fluid metering device consisting essentially of:

a fluid reservoir for containing a first fluid under pressure P1, an electronic pulsed signal generator selected from the group consisting of a programmable logic controller, a PC with an analog/digital I/O board, a datalogger, and a circuit, wherein said generator is connected with an electronically controlled three-way valve, said electronically controlled three-way valve operatively connected to said reservoir and to a source of a second fluid under pressure P2 wherein said valve is controlled by said signal generator to provide variable flow rates of said first fluid in a series of pulses of known volume, a float check valve operatively connecting said three-way valve with said reservoir, and a check valve operatively connected to said reservoir and to a source of a first fluid under pressure P1.

6. A digitally-controlled fluid metering device consisting essentially of:

a fluid reservoir for containing a first fluid under pressure P1, a pressure relief valve at the outlet end of said reservoir, an electronic pulsed signal generator operatively connected to an electronically controlled three-way valve, said electronically controlled three-way valve operatively connected to said reservoir and to a source of a second fluid under pressure P2 wherein said valve is controlled by said signal generator to provide variable flow rates of said first fluid in a series of pulses of known volume, a float check valve operatively connecting said three-way valve with said reservoir, and a check valve operatively connected to said reservoir and to a source of a first fluid under pressure P1.

7. A digitally-controlled fluid metering device consisting essentially of:

a fluid reservoir for containing a first fluid under pressure P1, an electronic pulsed signal generator selected from the group consisting of a programmable logic controller, a PC with an analog/digital I/O board, a datalogger, and a circuit, wherein said generator is connected with an electronically controlled three-way valve, said electronically controlled three-way valve operatively connected to said reservoir and to a source of a second fluid under pressure P2 wherein said valve is controlled by said signal generator to provide variable flow rates of said first fluid in a series of pulses of known volume, a float check valve operatively connecting said three-way valve with said reservoir, and a check valve operatively connected to said reservoir and to a source of a first fluid under pressure P1.

8. A digitally-controlled fluid metering device consisting essentially of:

a fluid reservoir having a floating ball within and a means for restricting travel of said ball; wherein said reservoir contains a first fluid under pressure P1, a pressure relief valve at the outlet end of said reservoir, an electronic pulsed signal generator operatively connected to an electronically controlled three-way valve, said electronically controlled three-way valve operatively connected to said reservoir and to a source of a second fluid under pressure P2 wherein said valve is controlled by said signal generator to provide variable flow rates of said first fluid in a series of pulses of known volume, a float check valve operatively connecting said three-way valve with said reservoir, and a check valve operatively connected to said reservoir and to a source of a first fluid under pressure P1.

* * * * *